US006332227B1

(12) United States Patent
Fang

(10) Patent No.: US 6,332,227 B1
(45) Date of Patent: Dec. 25, 2001

(54) RING BAND ADJUSTMENT STRUCTURE OF CRASH HELMET

(76) Inventor: Kuo-Yun Fang, 8F, No. 306, Sec. 6, Min Chuan E. Rd., Neihu District, Taipei (TW)

( * ) Notice: Subject to any disclaimer, the term of this patent is extended or adjusted under 35 U.S.C. 154(b) by 0 days.

(21) Appl. No.: 09/838,245

(22) Filed: Apr. 20, 2001

(30) Foreign Application Priority Data

Sep. 27, 2000 (TW) ..... 89216750 U

(51) Int. Cl.[7] ..... A42B 1/22

(52) U.S. Cl. ..... 2/418; 2/183

(58) Field of Search ..... 2/418, 417, 419, 2/420, 183, DIG. 11; 24/68 B, 274 WB

(56) References Cited

U.S. PATENT DOCUMENTS 6,219,851 * 4/2001 Fang ..... 2/418

* cited by examiner

*Primary Examiner*—Rodney M. Lindsey
(74) *Attorney, Agent, or Firm*—Rosenberg, Klein & Lee

(57) ABSTRACT

A ring band adjustment structure of a crash helmet comprises a ring band, a connection sheet, a guide bar, and a pair of locating adjusters. Two ends of the ring band are connected to the locating adjusters. The locating adjusters are connected to the guide bar so that the locating adjusters can move along a guide track formed at the edge of the guide bar. Through a control element in a slide grooves of the locating adjuster, a point-shaped unidirectional locating element on the bottom face of the inner end of the control element will leave from a corresponding strip-shaped unidirectional locating element of the locating bar on the guide bar, and the locating adjuster can move. Each end of the guide bar has a limit element so that the locating adjuster will not slide out.

9 Claims, 8 Drawing Sheets

RING BAND ADJUSTMENT STRUCTURE OF CRASH HELMET

FIELD OF THE INVENTION

The present invention relates to a ring band adjustment structure of a crash helmet and, more particularly, to a locating structure, whereby the diameter of a ring band can be appropriately adjusted according to the head size of a user.

BACKGROUND OF THE INVENTION

It is necessary to wear a crash helmet when riding a bicycle or a motorcycle. A ring band is provided in the crash helmet to be located and matched at the brow of a user. If the ring band is not an adjustable structure, it cannot apply to people having different sizes of heads. An adjustable ring band has been proposed, which has a connection seat and a cover body connected to two ends of the ring band. Although it has a hidden adjustment structure, because the connection seat needs to be fixedly joined with the cover body, a joining structure between them must be provided. Because the cover body is used to cover the connection seat, the main body of the connection seat and the main body of the cover body must have the same size. Therefore, some material is wasted. Moreover, the two ends of the ring band are locked at connection posts of an adjustment seat of the connection seat via through holes. The fixing effect of this kind of joining is not good so that other processing procedures must be matched, e.g., riveting the connection posts at the ring band. Therefore, the production cost is increased, and the manufacturing and assembling time is also increased. Additionally, the locating of a prior art adjuster can only be controlled by sense, resulting in inconvenient use. The present invention aims to resolve the above problems in the prior art.

SUMMARY OF THE INVENTION

An object of the present invention is to provide a ring band adjustment structure of a crash helmet, whereby two ends of the ring band can be easily joined with a locating adjuster, and the shifting and locating process of the locating adjuster is clearly visible so that adjustment can be performed in visual way. Moreover, because the two ends of the ring band are made of resilient locking structure, the assembling speed of the ring band with the locating adjuster will be faster. It is not necessary to use other auxiliary means, and the assembling and locating are more accurate. More importantly, the locating adjuster can be limited to only move within a certain range. Tail ends of a guide bar are used to limit distal ends of motion of the locating adjuster. The locating adjuster is joined with the guide bar in straddle way so that the locating adjuster can slide on the guide bar for locating. The required components are more compact, and the adjustment is more convenient.

The various objects and advantages of the present invention will be more readily understood from the following detailed description when read in conjunction with the appended drawing, in which:

DETAILED DESCRIPTION OF THE PREFERRED EMBODIMENTS

Figure 1:
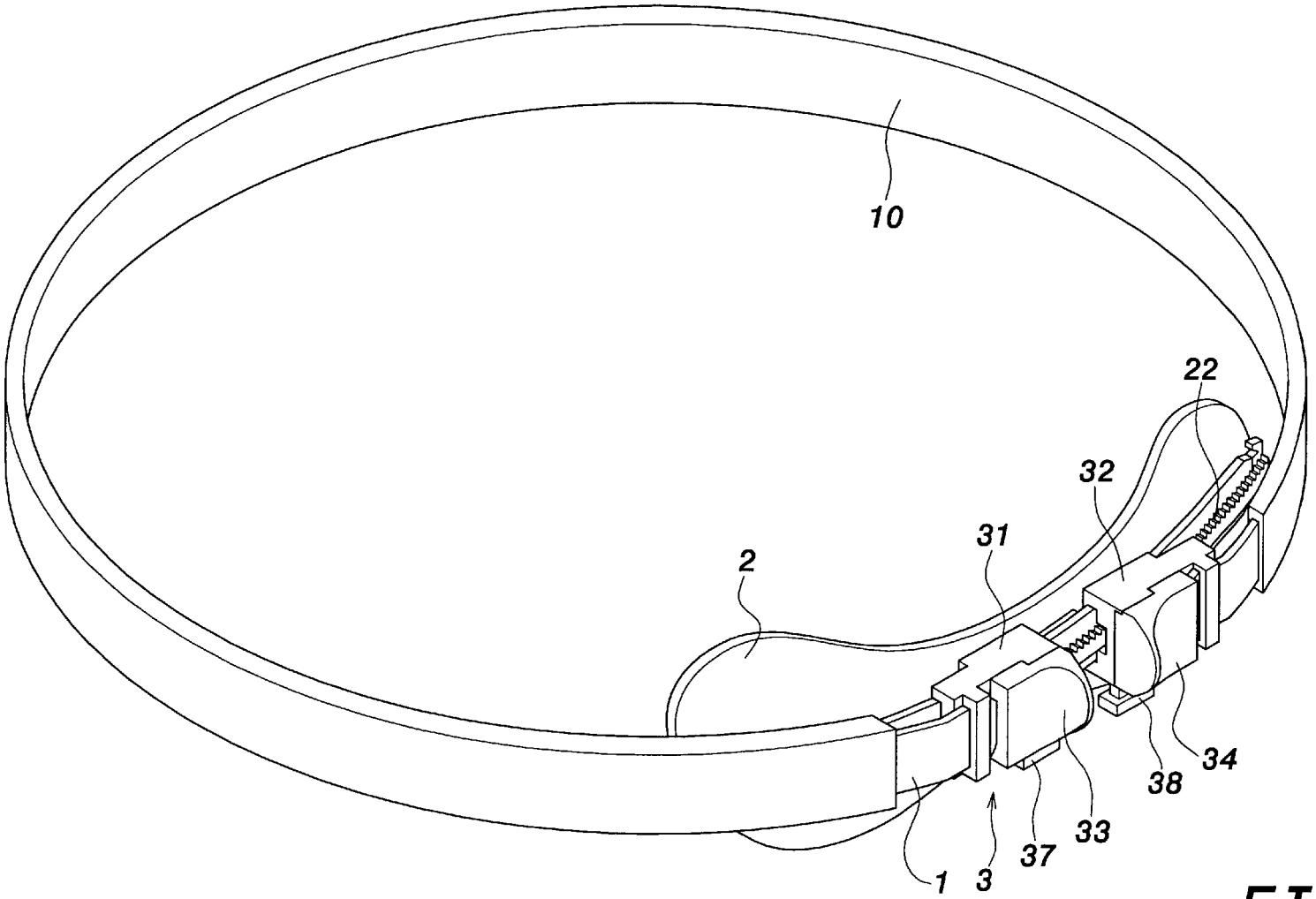
FIG. 1 is a perspective view of the present invention.

As shown in FIGS. 1 to 8, a ring band adjustment structure of the present invention comprises a ring band 1, a connection sheet 2, a guide bar 20, and a locating adjuster set 3. The ring band 1 is made of flexible material. The ring band 1 is a band of predetermined length and can be bent to form a ring. The ring band 1 can be sheathed by a soft sheathing body 10 to enhance comfort of wearing. The connection sheet 2 is a sheet of panel shape for connecting two ends of the ring band 1. The connection sheet 2 can be an arc body to assume a lying 8-shaped form so as to facilitate holding and to abut its set position. The locating adjuster set 3 is composed of a pair of locating adjusters, respectively being a left locating adjuster 31 and a right locating adjuster 32. Similarly, the guide bar 20 is connected to the connection sheet 2 with a connection bar 201. The height of the connection bar 201 is smaller than that of the guide bar 20. The surface of the guide bar 20 joins a locating bar, which is formed by joining a left locating bar 21 and a right locating bar 22. The side cross-sectional profiles of the guide bar 20 and the connection bar 201 are lying T-shaped. The inner face of the guide bar 20, the upper and lower parts of the connection bar 201, and the surface of the connection sheet 2 have guide slits in between. The two guide slits are divided to match the locating adjusters, and they are separated by a separating block 29. The guide slit at the left side of the separating block 29 is a left guide slit 23, and the guide slit at the right side of the separating block 29 is a right guide slit 24. An upper left guide 231 slit is at the upper left side of the separating block 29, a lower left guide slit 232 is at the lower left side thereof, an upper right guide slit 241 is at the upper right side thereof, and a lower right guide slit 242 is at the lower right thereof.

Figure 2:
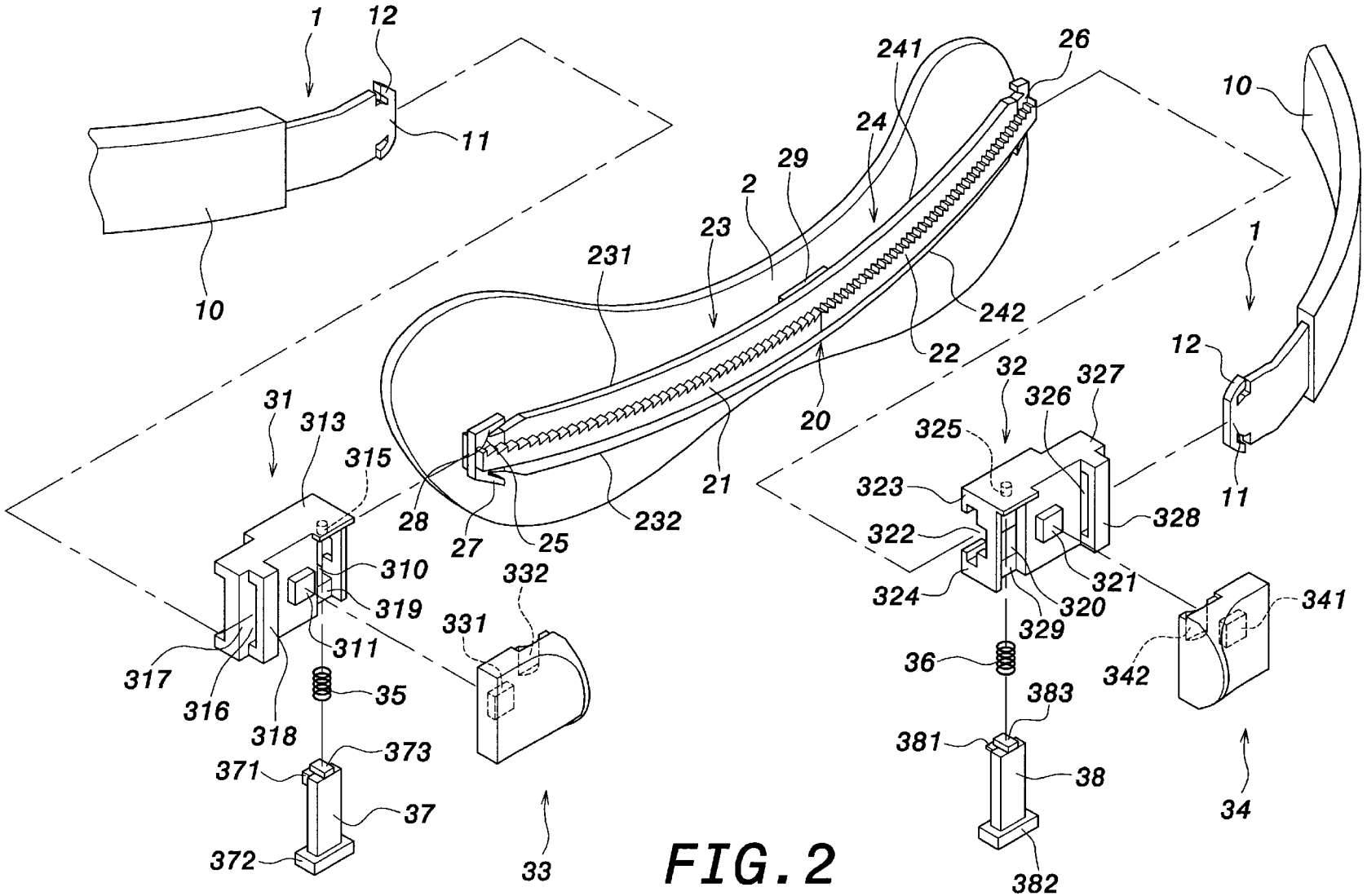
FIG. 2 is an exploded perspective view of the present invention.
Figure 3:
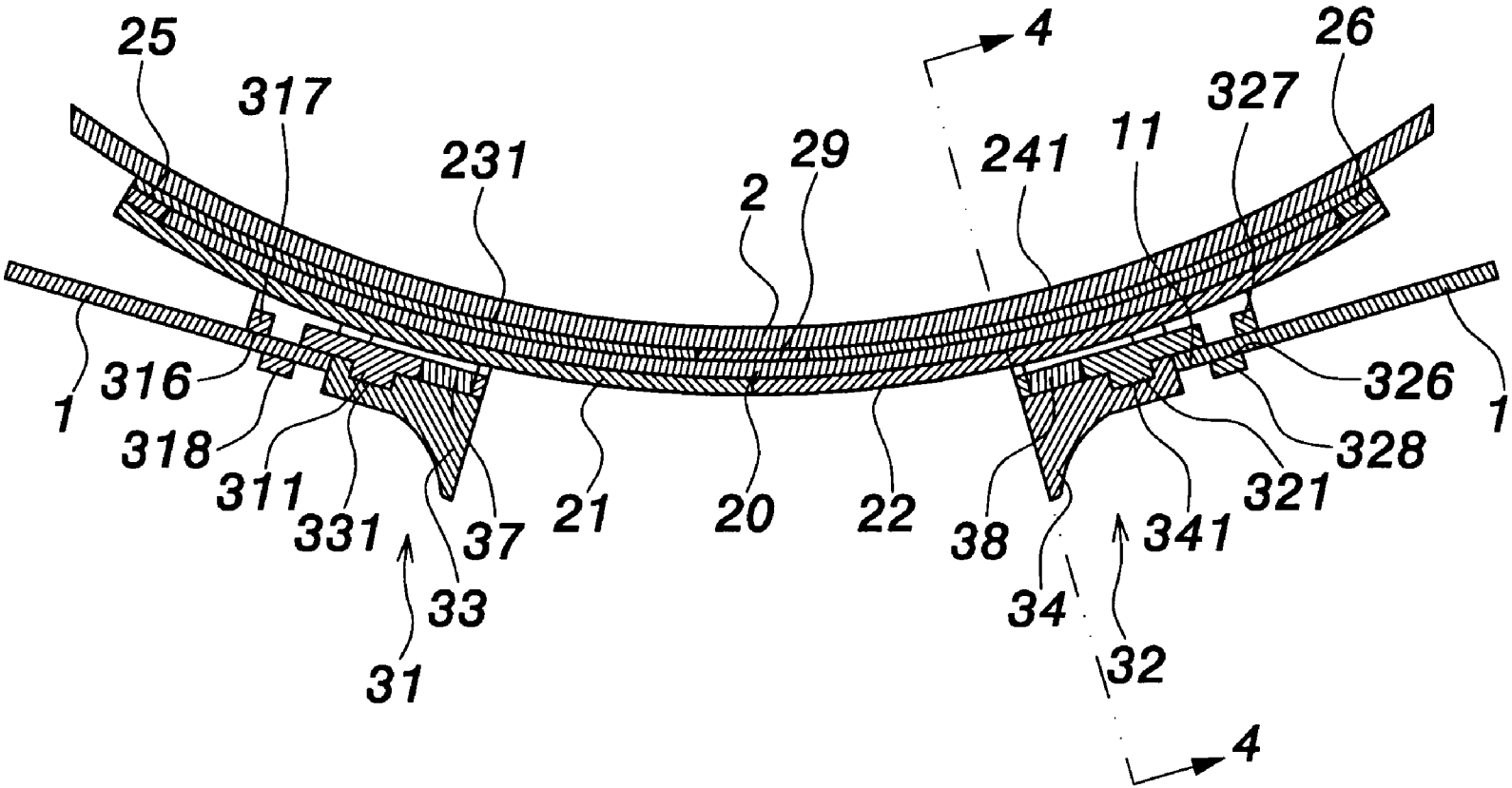
FIG. 3 is a transverse cross-sectional view of the present invention.
Figure 5:
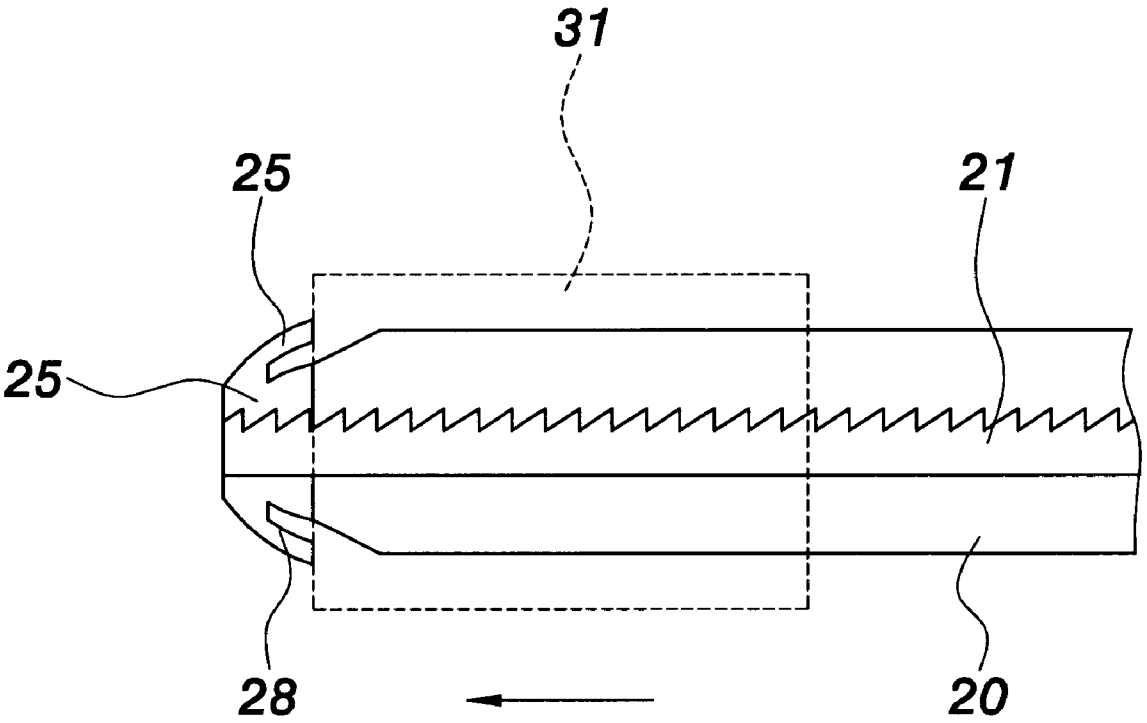
FIG. 5 is a view showing the relationship between a distal end of a guide bar and a locating adjuster of the present invention.

Each tail end of the guide bar 20 forms a limit element. As shown in FIG. 2, the limit element comprises a left anchor end 25 and a right anchor end 26 to let the left locating adjuster 31 and the right locating adjuster 32 respectively penetrate into the two ends of the guide bar 20. As shown in FIG. 5, the guide bar 20 uses the limit elements provided at the tail ends thereof (the anchor ends 25 and 26) to let the locating adjusters 31 and 32 not slide out. The anchor end is anchor-shaped. That is, the distal ends of the guide bar 20 forms two wing-shaped projective parts 27 and 28, which have a larger width than that of the guide bar 20. When the corresponding locating adjusters are locked at the guide bar 20, only the locating adjusters can be allowed to penetrate thereinto, and the two wing-shaped projective parts 27 and 28 of the anchor ends 25 and 26 can let the locating adjusters 31 and 32 not slide out, respectively.

The outer face of the guide bar 20 has a locating bar composed of strip-shaped unidirectional locating elements corresponding to point-shaped unidirectional locating elements disposed on the locating adjusters. The strip-shaped unidirectional locating element on the locating bar is a ratchet bar. The locating bar is separated into two symmetrically arranged halves, respectively being a left locating bar 21 and a right locating bar 22, each having a strip-shaped unidirectional locating element. The two strip-shaped unidirectional locating elements on the two half locating bars are arranged opposed to each other. In other words, the left locating bar 21 has a left ratchet bar, and the right locating bar 22 has a right ratchet bar. Because the ratchet is used here, a unidirectional fixing structure is formed, and quick slide motion will be generated in the other direction. The teeth of the ratchet bar are formed at the front end face of the locating bar. Because the left locating bar 21 and the right locating bar 22 are convexly provided at the center of the outer face of the guide bar 20, they have projective side profiles.

Figure 4:
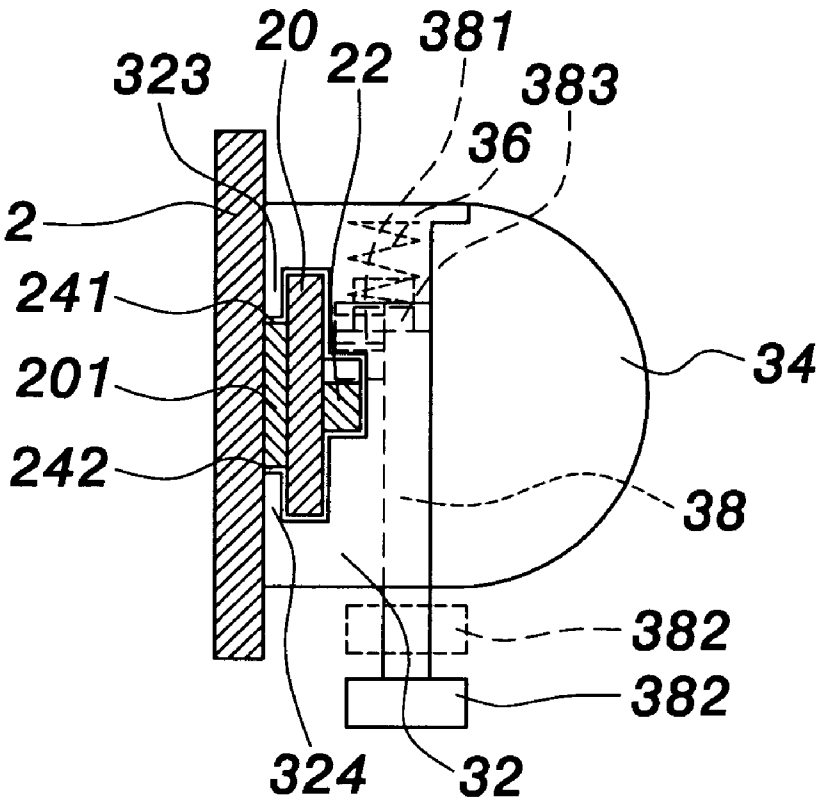
FIG. 4 is a cross-sectional view along the line 4—4 shown in FIG. 3 of the present invention.

Each of the locating adjusters 31 and 32 is formed of a locking body. Because the locating adjuster can be disposed at each of the two ends of the guide bar, it is only necessary to turn the locating adjuster 180 degrees to let the locating adjuster used at one side end to be used at the other side end. For instance, the right locating adjuster 31 has an upper L-shaped lock 323 and a lower L-shaped lock 324 respectively extending inwards from the top and bottom thereof to be embedded in the right guide slit 24. Thereby, the upper L-shaped lock 323 is locked in the upper right guide slit 241 above the connection bar 201, and the lower L-shaped lock 324 is locked in the lower right guide slit 242 below the connection bar 201. Therefore, the locking body of the locating adjuster can be locked on the guide bar 20 through the pair of L-shaped locks, as shown in FIG. 4. Please refer to FIG. 2. Only the right locating adjuster 32 is illustrated below. A side face of the right locating adjuster 32 has a groove 322 for providing a room to be penetrated into by the right locating bar 22.

Figure 6:
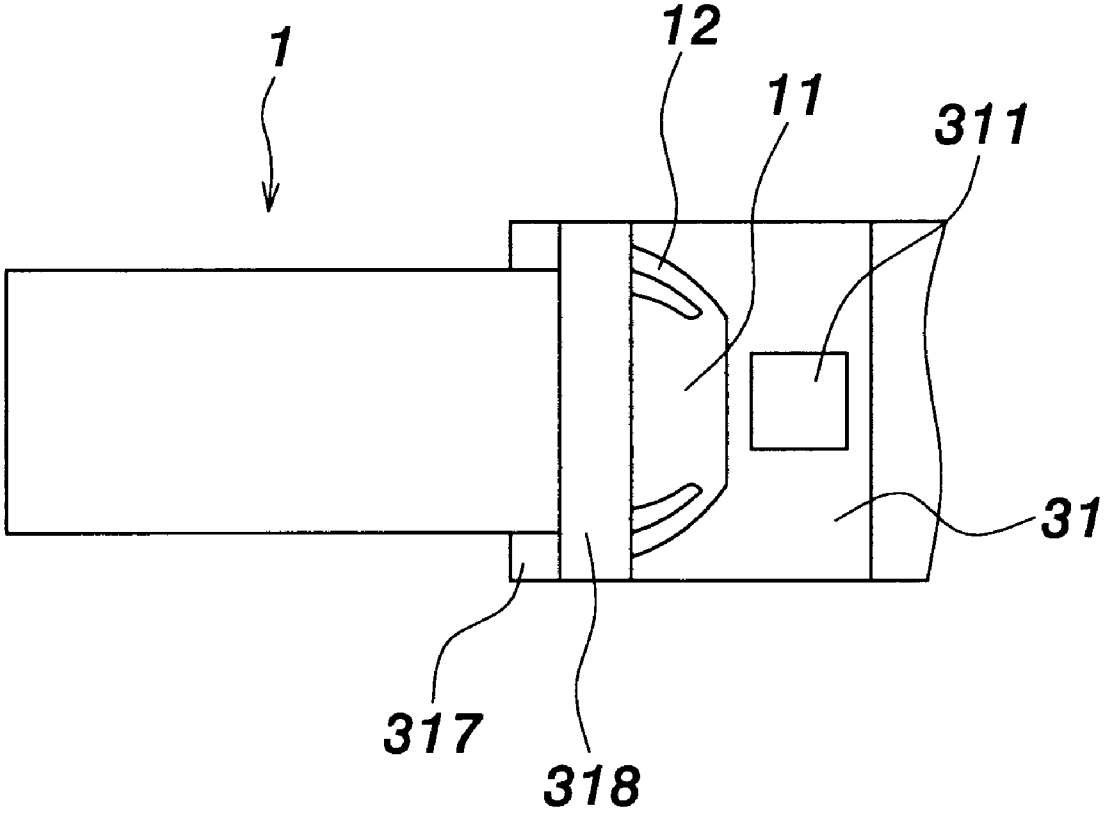
FIG. 6 is a cross-sectional view of the jointed state when distal ends of a ring band and a locating adjuster of the present invention.

The locking bodies of the locating adjusters 31 and 32 have through grooves 316 and 326 formed on side faces thereof, respectively. The through grooves 316 and 326 are sandwiched between rear clamping plates 317 and 327 and front clamping plates 318 and 328, respectively. The through grooves 316 and 326 are used to lock two ends of the ring band 1, respectively. Each end of the ring band 1 forms an anchor end 11 similar to the anchor end of the guide bar 20. As shown in FIG. 6, the anchor end 11 has a pair of embedded locating ends 12 having a larger width than that of the ring band 1. The embedded locating end 12 is arrow-shaped. After the embedded locating end 12 penetrates into the through hole 316 of the locking body, two locking ends 12 thereof are located at the inner part of the front clamping plate 318 (or 328) to let one end of the ring band 1 join the locating adjuster 31 or 32 for locating. The locating adjusters 31 and 32 are locked on the guide bar 20 so that the locating adjuster set 3 can move forwards and backwards along the guide slits 23 and 24 formed by the guide bar 20.

The front faces of the locating adjusters 31 and 32 have slide grooves 319 and 329 to be inserted by rod-shaped control elements 37 and 38, respectively. The slide grooves 319 and 329 are connected to springs (resilient elements) 35 and 36, respectively. One ends (upper ends shown in the figure) of the springs 35 and 36 are telescoped on locating posts 315 and 325 joined at the slide grooves 319 and 329 of the locating adjusters 31 and 32 so that inner ends 373 and 383 of the control elements 37 and 38 are connected to the other ends of the springs 35 and 36, respectively. Thereby, control elements 37 and 38 will slide in the corresponding slide grooves 319 and 329, respectively. The control elements 37 and 38 respectively have point-shaped unidirectional locating elements 371 and 381 protruding toward the bottom end faces of the inner faces of the slide grooves 319 and 329 from inner ends thereof. The control elements 37 and 38 have locking press ends 372 and 382 at outer ends thereof. The point-shaped unidirectional locating elements 371 and 381 respectively extend into through grooves 310 and 320 formed in the slide grooves 319 and 329. The through grooves 310 and 320 are connected with the groove 322 (only the groove of the right locating adjuster 32 is illustrated). The through grooves 310 and 320 are situated above the corresponding locating bars 21 and 22 so that the point-shaped unidirectional locating elements 371 and 381 can contact the strip-shaped unidirectional locating elements (ratchet bars) of the locating bars 21 and 22. By pressing the locking press ends 372 and 382, the point-shaped unidirectional locating elements 371 and 381 will leave from the strip-shaped unidirectional locating elements (ratchet bars) of the locating bars 21 and 22. Once the locking press ends 372 and 382 are released, the locked locating state is restored.

The locating adjusters 31 and 32 have lock elements 33 and 34 thereon, respectively. Bumps 311 and 321 on the locating adjusters 31 and 32 are embedded in grooves 331 and 341 on the bottom face of the lock elements 33 and 34, respectively. The lock elements 33 and 34 are also used to locate the control elements 37 and 38 and the springs 35 and 36 in the locating adjusters 31 and 32. The lock elements 33 and 34 have semi-circular arc grooves 332 and 342 at positions corresponding to the springs 35 and 36 so that part of the springs 35 and 36 can be embedded therein.

The point-shaped unidirectional locating elements 371 and 381 can be detached from the corresponding strip-shaped unidirectional locating elements of the locating bars 21 and 22. The strip-shaped unidirectional locating element shown in the figure is a ratchet bar, and the point-shaped unidirectional locating element 315 or 325 is a ratchet having at least a single tooth. The single tooth is also ratchet-shaped so that the ratchet can move on the ratchet bar. The characteristic of a ratchet is to generate unidirectional fixing. When pressing one end of the control element 33 or 34 near the ring band 1, the ratchet will be pulled upwards to leave from the position for locking the ratchet bar so that each of the locating adjusters can move freely.

The state of action is shown in FIG. 4. When not pressing the control element 33 or 34, the point-shaped unidirectional locating element of the control element of the locating adjuster 31 or 32 will be located on the corresponding strip-shaped unidirectional locating element of the locating bar so that the ring band cannot move, but the locating adjusters can move toward each other. i.e., toward the direction of shrinking the diameter of the ring band 1. That is, the locating adjusters 31 and 32 are allowed to only move unidirectionally toward the separating block 29 so as to shrink the ring band for locating. Contrarily, to release the locating state, it is necessary to press the control element to let the ratchet cancel the unidirectional limiting effect for the ratchet bar so that the locating adjusters can move away from each other so as to enlarge the diameter of the ring band.

Figure 7:
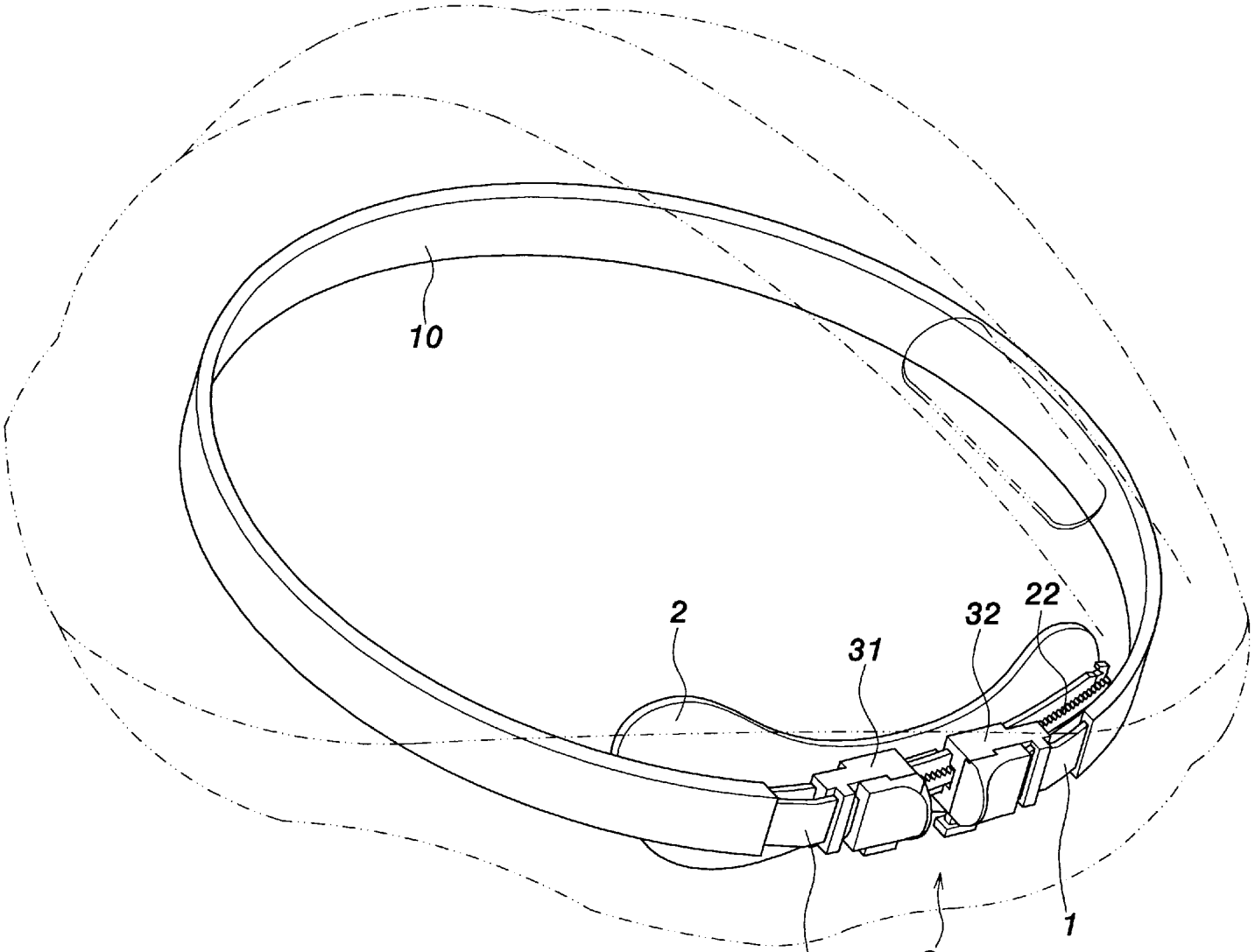
FIG. 7 is a perspective view showing a use state when disposed in a bicycle crash helmet of the present invention.
Figure 8:
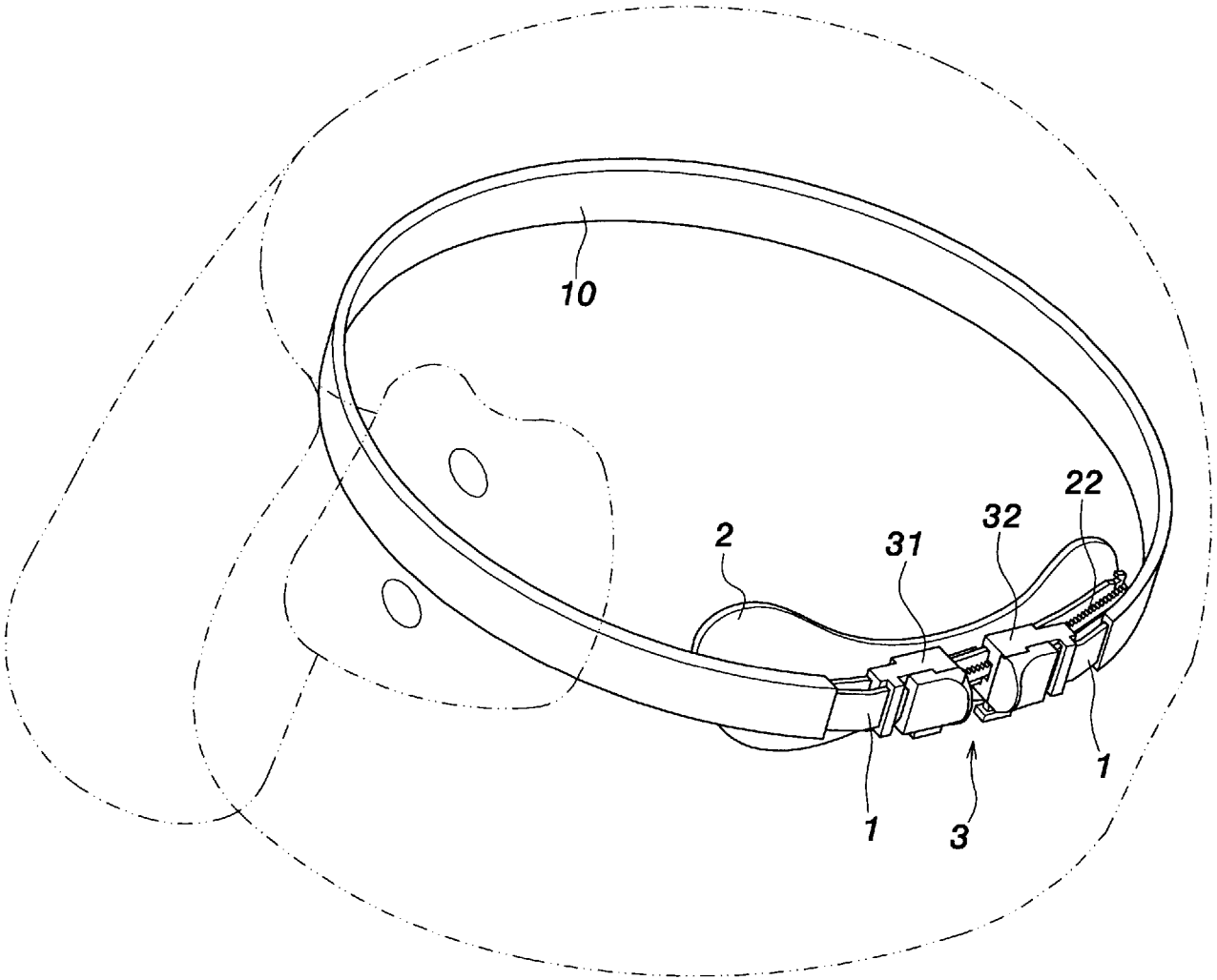
FIG. 8 is a perspective view showing a use state when disposed in a motorcycle crash helmet of the present invention.

Thereby, the diameter of the ring band can be adjusted freely, and the production cost can be reduced. Moreover, the structure is simplifier and the manufacture and assembly are easier, hence facilitating modular processing. FIG. 7 shows the situation that the present invention is joined in a bicycle crash helmet, and FIG. 8 shows the situation that the present invention is joined in a motorcycle crash helmet.

To sum up, the present invention uses two locating adjusters respectively joined at two ends of a ring band and straddled on two half locating bars on the outer face of a guide bar fixed on a connection sheet to let the ring band move on the guide bar along with the locating adjusters. Thereby, the diameter of the ring band can be adjusted freely. The adjustment is easy, and can be performed in visual way, hence being more accurate. As compared to the prior art, components and assembly time can be saved. The production cost is also reduced. Moreover, the structure is simplifier, and the manufacture and assembly are easier.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A ring band adjustment structure of a crash helmet, comprising:

a ring band;

a connection sheet of panel-shaped sheet;

a guide bar connected to said connection sheet, guide slits being respectively disposed above and below between said guide bar and said connection sheet;

a locating bar joined on said guide bar and divided into two symmetrically arranged halves, top faces of said two half locating bars respectively having strip-shaped unidirectional locating elements, which are arranged opposed to each other; and two locating adjusters each connected to one end of said ring band, a top side and a bottom side of said locating adjuster extending rearwards to form a pair of L-shaped locks, said pair of L-shaped locks being embedded in the guide slits of said guide bar to let said locating adjuster straddle said guide bar and move along the edge of said guide bar, each of said locating adjusters having a slit at a side face thereof to be penetrated into by said locating bar and having a slide groove at a front face thereof, said slide groove having a resilient element and a through groove connected with said slit therein, each of said locating adjusters having a control element partly inserted in said slide groove, an inner end of said control element being joined with the other end of said resilient element, said control element having a point-shaped unidirectional locating element extending toward said slide groove from a back face of an inner end thereof, said point-shaped unidirectional locating element being locked on said strip-shaped unidirectional locating element on said guide bar;

whereby when said point-shaped unidirectional locating element in said control element leaves from said corresponding strip-shaped unidirectional locating element on said guide bar, the diameter of said ring band can be adjusted through the sliding of said locating adjusters.

2. The ring band adjustment structure of a crash helmet as claimed in claim 1, wherein said ring band can be sheathed by a soft sheathing body.

3. The ring band adjustment structure of a crash helmet as claimed in claim 1, wherein said ring band can be bent to form a ring shape.

4. The ring band adjustment structure of a crash helmet as claimed in claim 1, wherein each end of said ring band has an anchor end to be embedded in said locating adjuster.

5. The ring band adjustment structure of a crash helmet as claimed in claim 1, wherein said connection sheet is arc-shaped.

6. The ring band adjustment structure of a crash helmet as claimed in claim 1, wherein each end of said guide bar has a limit element to prevent said locating adjuster from sliding out.

7. The ring band adjustment structure of a crash helmet as claimed in claim 1, wherein said strip-shaped unidirectional locating element of said locating bar is a ratchet bar.

8. The ring band adjustment structure of a crash helmet as claimed in claim 1, wherein said point-shaped unidirectional locating element of said control element in said locating adjuster is a ratchet having at least a single tooth.

9. The ring band adjustment structure of a crash helmet as claimed in claim 1, wherein said locating adjuster has a through groove to be penetrated into by said ring band for fixing.

* * * * *